US005715806A

United States Patent [19]

Tonegawa et al.

[11] Patent Number: 5,715,806

[45] Date of Patent: Feb. 10, 1998

[54] MULTI-WIRE SAW DEVICE FOR SLICING A SEMI-CONDUCTOR INGOT INTO WAFERS WITH A CASSETTE FOR HOUSING WAFERS SLICED THEREFROM, AND SLICING METHOD USING THE SAME

[75] Inventors: Tadashi Tonegawa, Shiki-gun; Junzo Wakuda, Kashihara, both of Japan

[73] Assignee: Sharp Kabushiki Kaisha, Osaka, Japan

[21] Appl. No.: 572,608

[22] Filed: Dec. 14, 1995

[30] Foreign Application Priority Data

Dec. 15, 1994 [JP] Japan ..... 6-311624
Mar. 27, 1995 [JP] Japan ..... 7-068125

[51] Int. Cl.[6] ..... B28D 1/08

[52] U.S. Cl. ..... 125/16.02; 125/21; 125/1

[58] Field of Search ..... 125/12, 1, 16.02, 125/21; 83/783, 784; 219/121.18, 121.35

[56] References Cited

U.S. PATENT DOCUMENTS

| | | | |
|---|---|---|---|
| 1,619,128 | 1/1927 | Jobst | 125/12.1 |
| 2,024,715 | 12/1935 | Bennett . | |
| 3,032,026 | 5/1962 | Raabe | 125/21 |
| 3,540,427 | 11/1970 | Anderson | 125/21 |
| 3,599,623 | 8/1971 | Phy | 125/21 X |
| 4,287,869 | 9/1981 | Schmid | 125/12 X |
| 4,625,093 | 11/1986 | Chyssolouris . | |
| 4,655,191 | 4/1987 | Wells et al. . | |
| 5,054,626 | 10/1991 | Stempinski . | |
| 5,201,305 | 4/1993 | Takeuchi | 125/21 |
| 5,351,446 | 10/1994 | Langsdorf . | |

FOREIGN PATENT DOCUMENTS

| | | |
|---|---|---|
| 61182761 | 8/1986 | Japan . |
| 4-169204 | 6/1992 | Japan . |
| 4-169205 | 6/1992 | Japan . |
| 7-153724 | 6/1995 | Japan . |
| 715345 | 2/1980 | U.S.S.R. . |

OTHER PUBLICATIONS

IBM Technical Disclosure Bulletin, vol. 16, No. 10, Mar. 1974, New York US, p. 3237 A.S. Shah et al. "Row–Pass Laser Cutting".

*Primary Examiner*—Timothy V. Eley

[57] ABSTRACT

A multi-wire saw device for slicing a semiconductor ingot and method therefore provides a plurality of spaced wires for cutting the ingot which is held by two sets of clip boards therebetween. The sets of clip boards form a holding means which may ascend and descend in order to engage the cutting wires. The multi wire saw device includes a cassette having chambers partioned by wires extending between opposite cassette ends and into which individual wafers fall. The cassette is formed with teflon resin for easy entry of the wafers.

8 Claims, 10 Drawing Sheets

MULTI-WIRE SAW DEVICE FOR SLICING A SEMI-CONDUCTOR INGOT INTO WAFERS WITH A CASSETTE FOR HOUSING WAFERS SLICED THEREFROM, AND SLICING METHOD USING THE SAME

BACKGROUND OF THE INVENTION

1. Field of the Invention

The present invention relates to a multi-wire saw device used for slicing a semiconductor ingot block and cutting the sliced ingot into a semiconductor wafer, and to a slice method using the same and to a cassette for housing a wafer sliced with the same.

2. Description of the Related Art

When slicing a semiconductor ingot block of lump semiconductor by using a conventional multi-wire saw device (hereinafter occasionally abbreviated to "MWS device"), first fixs a metal plate, made of aluminum or the like, or a carbon board on a base plate mounted in the MWS device using vises or by inserting both ends of the metal plate or carbon board into the base plate.

Next, referring to FIG. 10A, one bonds a disposable board 101 of glass board or carbon board to the aluminum plate with adhesive. Then, a semiconductor ingot block 103 is bonded to the disposable board 101 with adhesive 102.

With respect to the semiconductor ingot block 103, for example, the wafer cut surface thereof comprises a square and is the width direction comprises a long rectangle. Or, a substantially circular semiconductor ingot block having partially flat cut surface in the width direction is also sufficient.

After mounting this set ingot holder on the MWS device, start slice while applying a slurrey consisting of a mixture of whetstone grain and oil. When a slice advances and a wire cuts into the disposable board 101 to a degree (several mm), slicing ends (refer to FIG. 10B).

After this, one withdraws the wire from the disposable board 101 and the semiconductor block and remances the ingot holder from the MWS device.

Thereafter, remove the slurry sticking to the semiconductor wafer with light oil, then dip it into a dedicated solution for stripping off the epoxy adhesive 102 and peel semiconductor wafers from the disposable board 101 one by one. The semiconductor wafers peeled off are manually housed one by one in the wafer cassette.

The peeled wafer is housed in the cassette. As materials for a partition separating wafers in the cassette, resins, such as fluorine and Teflon, or metals, such as aluminum, are used and the spaces between wafers must be taken to be as wide as several mm from the point of structural view. Thus, from a consideration of the factors of working conditions, such as weight and size of a cassette, the number of housed wafers is normally 20 to 25 sheets.

For a slice width of less than 1 mm, any plate-like partition made of resin or metal is extremely diminished in strength and cannot substantially function as "partition". In addition, when using a thin plate as a partition, it is extremely difficult to maintain the flatness over the whole surface. Further, there is a fear about mutual contact of adjacent walls. A tens to hundreds of μm thick plate has only a strength substantially equal to that of papers and is far inferior in strength such that it does not serve well as a partition.

With the above multi-wire saw device and the slice method using the same, a wire cuts into a part of the disposable board 101 which is needed for slicing each semiconductor ingot block, thereby raising the production cost.

In addition, adjacent semiconductor wafers peeled off from a disposable board 101 stick to each other before housing in the wafer cassette and are difficult to separate, thereby lowering the yield due to cracking and fragmentation as well as impairing the operational efficiency.

Furthermore, as mentioned above, it is required in slicing to adhere a semiconductor ingot to a disposable board, but in the case of an adhesive comprising two liquids, the steps of taking out and mixing the main ingredient and the hardening agent, uniformly applying the adhesive to the disposable board and tearing off a wafer from the disposable board are needed resulting in an increase in cost from the viewpoints of number of steps and material costs (disposable board and adhesive).

SUMMARY OF THE INVENTION

It is a first object of the present invention to provide a multi-wire saw that needs neither disposable board nor adhesive and can omit the steps of applying the adhesive to the disposable board and tearing off the adhesive after slice, and a slice method using the same, enabling a cost cut in materials, yield improvement and a raising of operational efficiency.

It is a second object of the present invention to provide a wafer housing cassette used for the above multi-wire saw thereby permitting a narrow partition interval.

The aforesaid first object can be achieved with a multi-wire saw for cutting a semiconductor ingot into plurality of wafers by using a row of wires spanned at predetermined spaces, comprising hold means for holding the semiconductor ingot therein and moving it at a right angle to the travelling direction of the wire for cutting it into wafers, wherein it is arranged to have wafers fall from the hold means into a wafer housing cassette after the completion of cutting.

The aforesaid second object can be achieved with the multi-wire saw of the present invention wherein the hold means comprises a first sandwich holding section for holding a semiconductor ingot therein at the first half of the cutting step and a second sandwich holding section for holding the semiconductor ingot therein at the second half of the cutting step.

The aforesaid second object can be achieved with the wafer housing cassette of the present invention wherein wires, 50 to 300 μm in diameter, are spanned as partitions for separating wafers from each other.

With the multi-wire saw of the present invention, a wafer is seperated and inserted into the cassette simultaneously to the completion of cutting. In addition, because of no need for either disposable board or adhesive, the step of tearing off the adhesive and a very laborious work of manually tearing off a wafer hardly separable due to the residual slurry can be omitted.

With the cassette of the present invention, the partition interval can be narrowed while keeping a sufficient strength of partitions because a wire is used as the partition.

The multi-wire saw device of the present invention is a multi-wire saw device for cutting a semiconductor ingot into a plurality of semiconductor wafers by using a row of wires tensely arranged at predetermined spaces, comprising hold means for holding the semiconductor ingot and a laser for cutting the semiconductor ingot at a right angle to the cutting direction of the wires.

The multi-wire saw device of the present invention is a device wherein the laser is arranged to be movable vertically, longitudinally and transversely.

The multi-wire saw device of the present invention is a device further comprising a wafer cassette for housing a semiconductor wafer falling below the semiconductor ingot after the completion of cutting of a slice.

The multi-wire saw device of the present invention is a device in which the wafer cassette includes housing sections for individually housing individual semiconductor wafers, further comprising control means for controlling the focal position of the laser on the semiconductor wafer to be cut and for controlling the position of the housing area start surface in the housing section for housing the relevant cut semiconductor wafer to align below such wafer.

The slice method of the present invention using the multi-wire saw device of the present invention is a method wherein the wafer cut surface of the semiconductor ingot is a rectangle, comprising: the steps of fixing the short side of the semiconductor ingot on the hold means; half-slicing the semiconductor ingot in the range from the short side up to the long side of the cut surface thereof; and cutting, the semiconductor wafer after wire cutting in such a manner, the wafer cut surface becomes a square by means of the laser.

With these arrangements, because of being arranged to comprise a laser for cutting the semiconductor ingot at a right angle to the cutting direction of the wire, the multi-wire saw device of the present invention can cut the semiconductor ingot into individual semiconductor wafers by using a row of wires and the laser and separate them from each other. Thus, it becomes unnecessary to slice into the hold means by means of wires.

Because the laser is arranged to be movable vertically, longitudinally and transversely, the multi-wire saw device of the present invention can set the size of two vertical sides in the cut surface of a semiconductor wafer by the vertical translation, cut it into a semiconductor wafer by the longitudinal translation and adjust the focal position of the laser to each semiconductor wafer.

Because of being arranged to further comprise a wafer cassette for housing a semiconductor wafer falling from the semiconductor ingot after the completion of cutting, the multi-wire saw device of the present invention in which the cut semiconductor wafers are automatically housed in the wafer cassette, one can omit the very laborious operation of manually separating semiconductor wafers which are difficult to separate due to the residual slurry.

Because of an arrangement that the wafer cassette includes housing sections for individually housing individual semiconductor wafers and control means is further provided for controlling the focal position of the laser on the semiconductor wafer to be cut and the position of the housing area start surface in the housing section for housing the relevant semiconductor wafer to come into much the same plane, the multi-wire saw device of the present invention can stably house the semiconductor wafers in the housing section of the wafer cassette even if a variation occurs in the thickness of cut semiconductor wafers.

With the slice method of the present invention, because the wafer cut surface of the semiconductor ingot comprises a rectangle and this method is arranged to comprise the steps of fixing the short side of the semiconductor ingot on the hold means; half-slicing the semiconductor ingot in the range from the short side up to the long side of the cut surface thereof; and cutting the semiconductor wafer after cutting in such a manner the wafer cut surface becomes a square by means of said laser, semiconductor wafers whose cut surface after cutting is a square can be consistently obtained without the use of a disposable board as a part of the hold means or without wasting a disposable board, if one is used.

Further objects and advantages of the present invention will be apparent from the following description of the preferred embodiments of the present invention as illustrated in the accompanying drawings.

BRIEF DESCRIPTION OF THE DRAWINGS

FIG. 7A shows the state before slice and FIG. 7B shows the state after slice.

FIG. 8A is a front sectional view and FIG. 8B is a side view.

FIG. 10A shows the state before slice and FIG. 10B shows the state after slice.

DESCRIPTION OF THE PREFERRED EMBODIMENTS

Figure 1A:
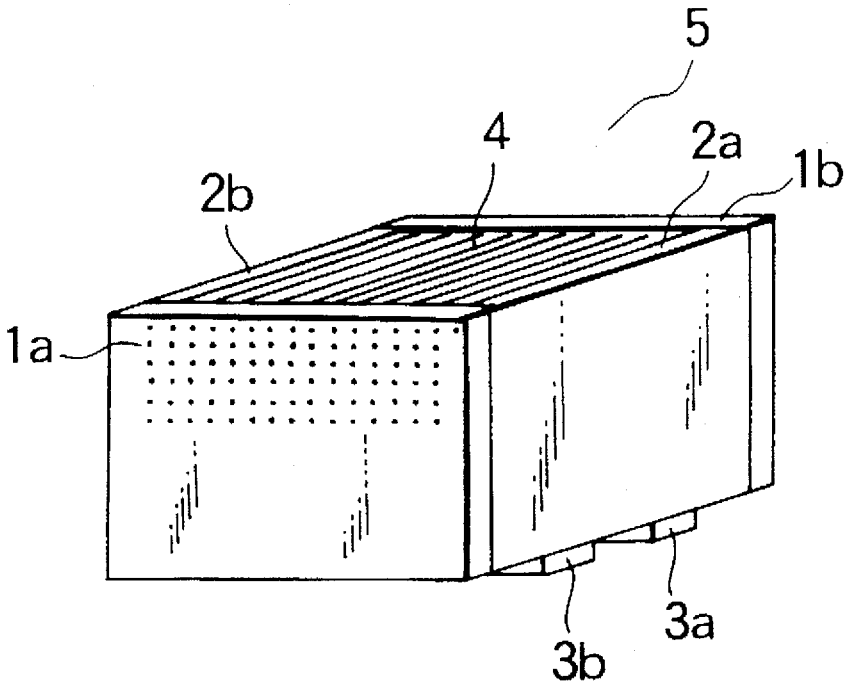
FIG. 1A is a perspective view showing a cassette according to the present invention.

Hereinafter, one embodiment of the present invention will be described by referring to the drawings.

Figure 3:
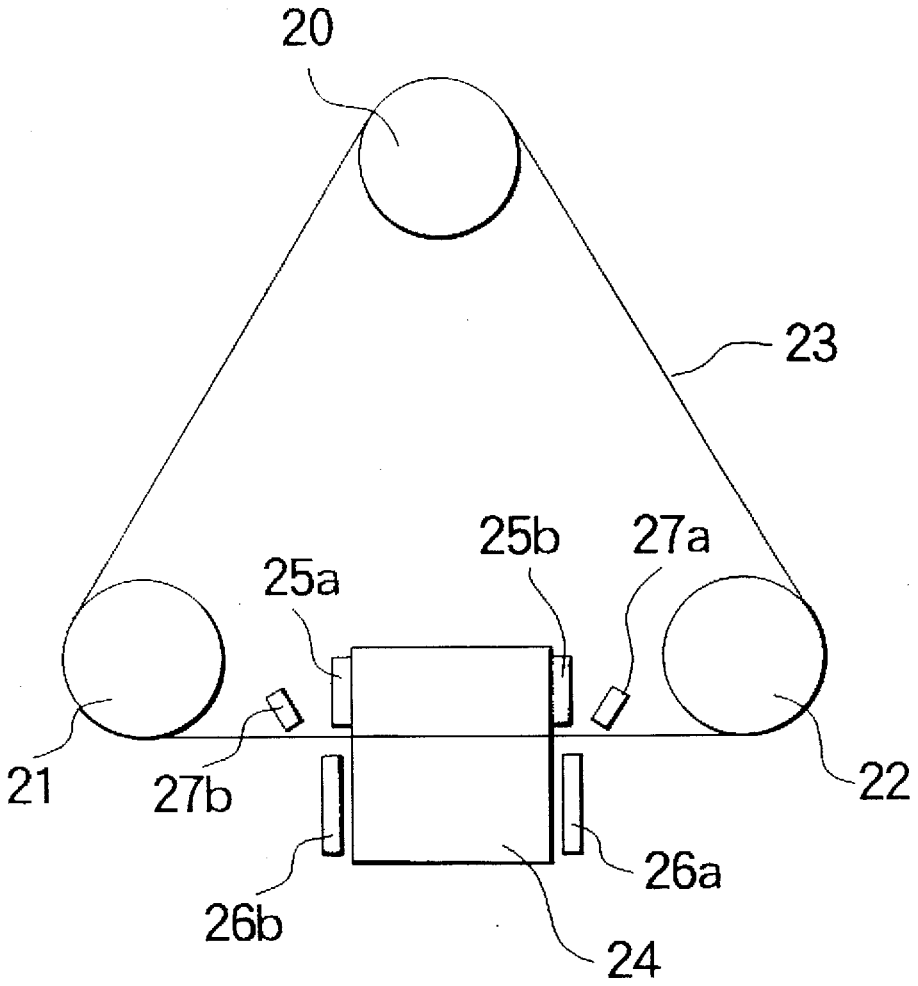
FIG. 3 is a structure outline of a multi-wire saw according to the present invention.

As shown in FIG. 3, a multi-wire saw according to this embodiment is provided with three wire guides 20, 21 and 22. In these wire guides, grooves corresponding to the thickness of the wafer to be sliced and the diameter of a wire are cut and wires 23 are wound along these grooves at a pitch of 600 μm. These wires 23 are travelled by a wire drive not shown.

Between the wire guides 21 and 22, two sets of clip boards 25*a*, 25*b* and 26*a*, 26*b* for holding a 100×100×160 mm crystalline silicon block 24 therebetween are disposed movable on a wall free to ascend and descend 28 (See FIGS. 4A to 4D). Incidentally, the clip boards 25*a*, 25*b* as the first sandwich hold section are 40 mm wide and as the second sandwich hold section, namely, the chip boards 26*a*, 26*b*, are 50 mm wide. Rubber is placed on the contact surface of these clip boards with the silicon block 24 so as to keep the silicon block 24 from being damaged. Furthermore, near the wire guides 21 and 22 are disposed slurry nozzles 27*a* and 27*b* for jetting slurry, a mixture of whetstone grains and oil, having a lubricity and grindability.

Figure 1B:
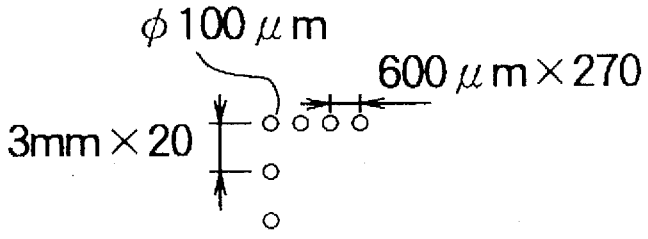
FIG. 1B is to illustrate an arrangement of holes on boards of the cassette.

In addition, a multi-wire saw is provided with a cassette 5 as shown in FIG. 1A for housing sliced wafers, it is. As material of a cassette, Teflon resin is used. In the 190×110×10 mm boards 2*a* and 2*b*, as shown in FIG. 1B, 20 holes, 100 μm in diameter, are bored vertically at a 3 mm pitch and 230 rows of holes are bored horizontally at a 600 μm pitch. Between these boards 1*a* and 1*b*, two 105×110×10 mm boards 2*a* and 2*b* are disposed, at the bottom of which rod-like boards 3*a* and 3*b* are disposed as the base boards for preventing the fall of housed wafers.

Between holes bored the boards 1*a* and 1*b*, a wire 4 is spanned as partition. A 70 μm-diametered tungsten wire is used for wire 4.

Figure 2A:
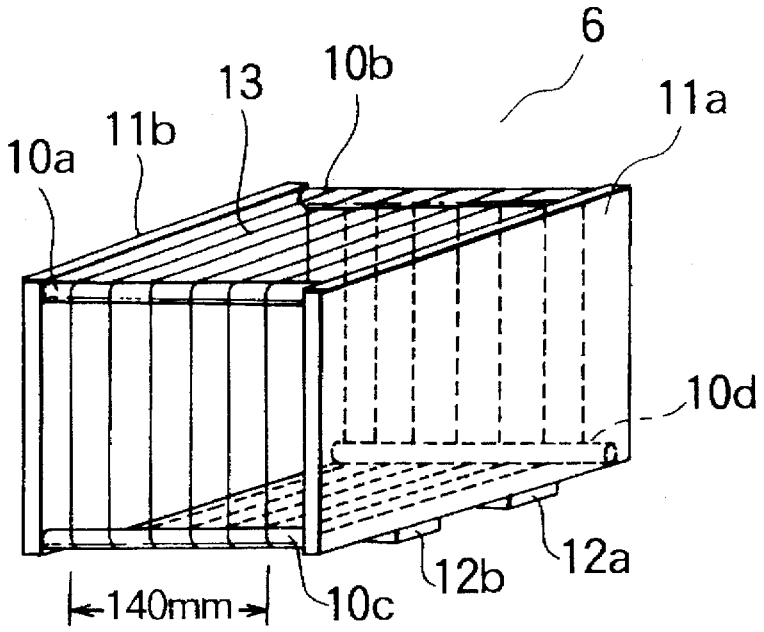
FIG. 2A is a perspective view showing another cassette according to the present invention.
Figure 2B:
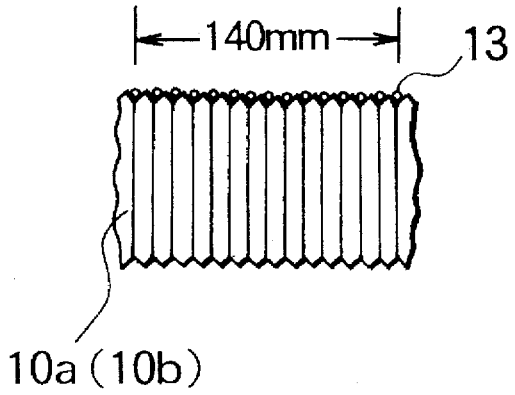
FIG. 2B is to illustrate wires serving as partitions.

A cassette may be arranged as shown in FIG. 2A. In FIG. 2A, the cassette 6 comprises side boards 11*a* and 11*b*, at whose four corners SUS round bars 10*a*, 10*b*, 10*c* and 10*d* of 18 mm diameter and 180 mm length are disposed for holding the side boards 11*a* and 11*b* at a predetermined space. These round bars 10*a*, 10*b*, 10*c* and 10*d* are covered with 1 mm thick Teflon tubes, on which grooves, 60 μm in depth, are cut at a 600 μm pitch. The spacing of the round bars 10*a*, 10*c* to those 10*b*, 10*d* is respectively 100 mm, whereas that of the round bars 10*a*, 10*b* to those 10*c*, 10*d* is respectively 125 mm. Furthermore, at the bottom, the boards 12*a* and 12*b* are disposed, forming a floor for preventing the housed wafers from falling. As shown in FIG. 2B, on the round bars 10*a*, 10*b*, 10*c* and 10*d*, a plurality of wires 13 serving as partitions are disposed over a width of 70 mm from the center to the right and the left, that is, total width of 140 mm at a pitch of 600 μm.

Next, the operation of this embodiment will be described by referring to FIGS. 4A to 4D and 5. Incidentally, with this embodiment, each end of a 160 mm long semiconductor block cut off by 10 mm, and accordingly the actual slice width is 140 mm.

Figure 4A:
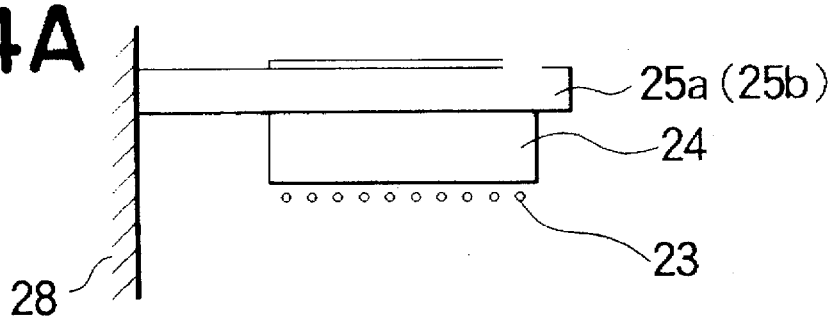
FIGS. 4A to 4D are explanatory drawings of the operation of a multi-wire saw according to the present invention.
Figure 4B:
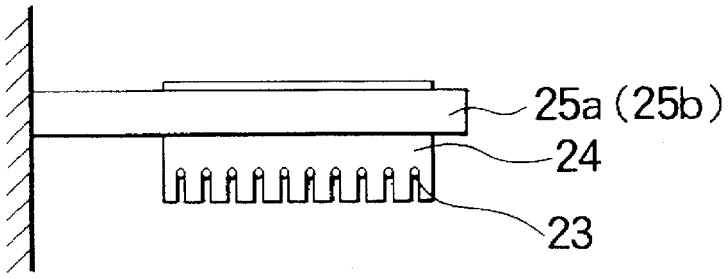
Figure 4C:
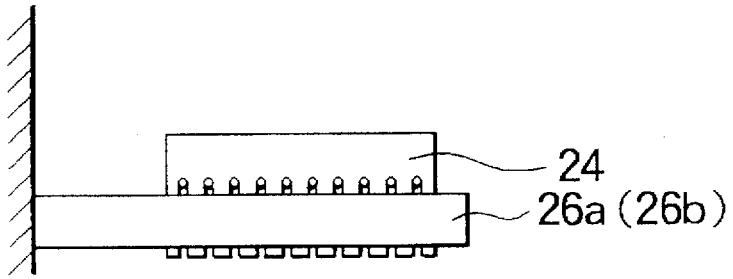

First, as shown in FIG. 4A, the clip boards 25*a* and 25*b* move forward and hold the top of a semiconductor block 24 therebetween. In this state, when the multi-wire saw starts, the wire 23 travels and simultaneously slurry jets from the slurry nozzles 27*a* and 27*b*. The wall 28 is lowered by a not shown lift mechanism and consequently the clip boards 25*a* and 25*b* lower. With this lowering movement, slicing the semiconductor block 24 with the wire 23 is accomplished as shown in FIG. 4B. Incidentally, because the width of the clip boards 25*a* and 25*b* is 40 mm, when slicing the semiconductor block 24 goes on the order of 55 mm and the wire 23 comes near the clip boards 25*a* and 25*b*, the clip boards 26*a* and 26*b* move forward and hold the lower portion of the semiconductor block 24 therebetween as shown in FIG. 4C. At this time, the lower end of the semiconductor block 24 is kept exposed on the order of 2 mm from the bottom of the clip boards 26*a* and 26*b*. Sandwich hold of the semiconductor block 24 with the clip boards 25*a* and 25*b* is released and further the clip boards 26*a* and 26*b* are lowered by a not shown lift mechanism, thereby continuing the slicing of the semiconductor block 24.

Meanwhile, because the clipping force of the clip boards 26*a* and 26*b* disperses on each wafer 7 and both 10 mm end portions of the block 24, no breakage of a wafer occurs. The thickness of a wafer can be set at 200 to 450 μm and the cutting off ranges from 210 to 220 μm.

Figure 4D:
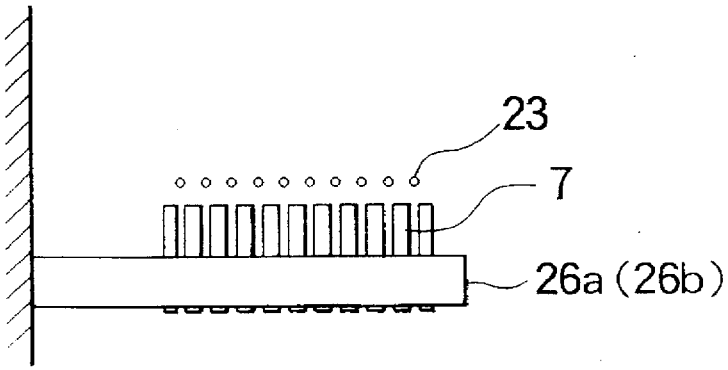
Figure 5:
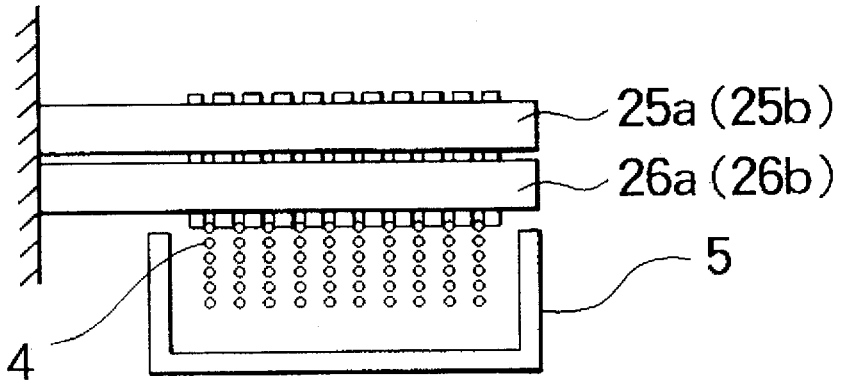
FIG. 5 is an explanatory drawing of the operation of a multi-wire saw according to the present invention.

At the termination of slicing, as shown in FIG. 4D, the wafer 7 is held between clip boards 26*a* and 26*b* and the lower end of each wafer is exposed on the order of 2 mm from the bottom of the clip boards 26*a* and 26*b*. Here, as shown in FIG. 5, the top wires 4 of the cassette 5 are inserted into the respective gaps between a plurality of wafers 7 and each wafer is held between the clip boards 25*a* and 25*b* as well. Next, the hold between the clip boards 26*a* and 26*b* is released. Then, with lowering clip boards 25*a* and 25*b* driven by the not shown lift mechanism, each wafer begins to be housed along the relevant wires 4 serving as partitions of the cassette 5, and when the half length of each wafer 7 is housed in the cassette 5, the hold between the clip boards 25*a* and 25*b* is released and individual wafers 7 are housed into the cassette 5 while separated by the wires 4 serving as partitions of the cassette 5.

Incidentally, since slurry happens to gather between the respective wafers 7 and consequently their sticking together is highly probable, it is advisable that the clip boards 26*a* and 26*b* are arranged to be somewhat swingable longitudinally and transversely and that the wafers 7 easily fall into the cassette 5.

With the instant multi-wire saw, wafers can be housed into the cassette simultaneously with the completion of cutting and the very laborious work of manually tearing off a difficult to separate wafer can be omitted. In addition, because of no need for either disposable board nor adhesive, the steps of applying and tearing off the adhesive can be omitted, thereby facilitating the operation greatly, thus, expendables, such as adhesive and disposable boards, can be saved, thereby enabling a cost savings.

Hereinafter, another embodiment of the present invention will be described by referring to the drawings.

Figure 6:
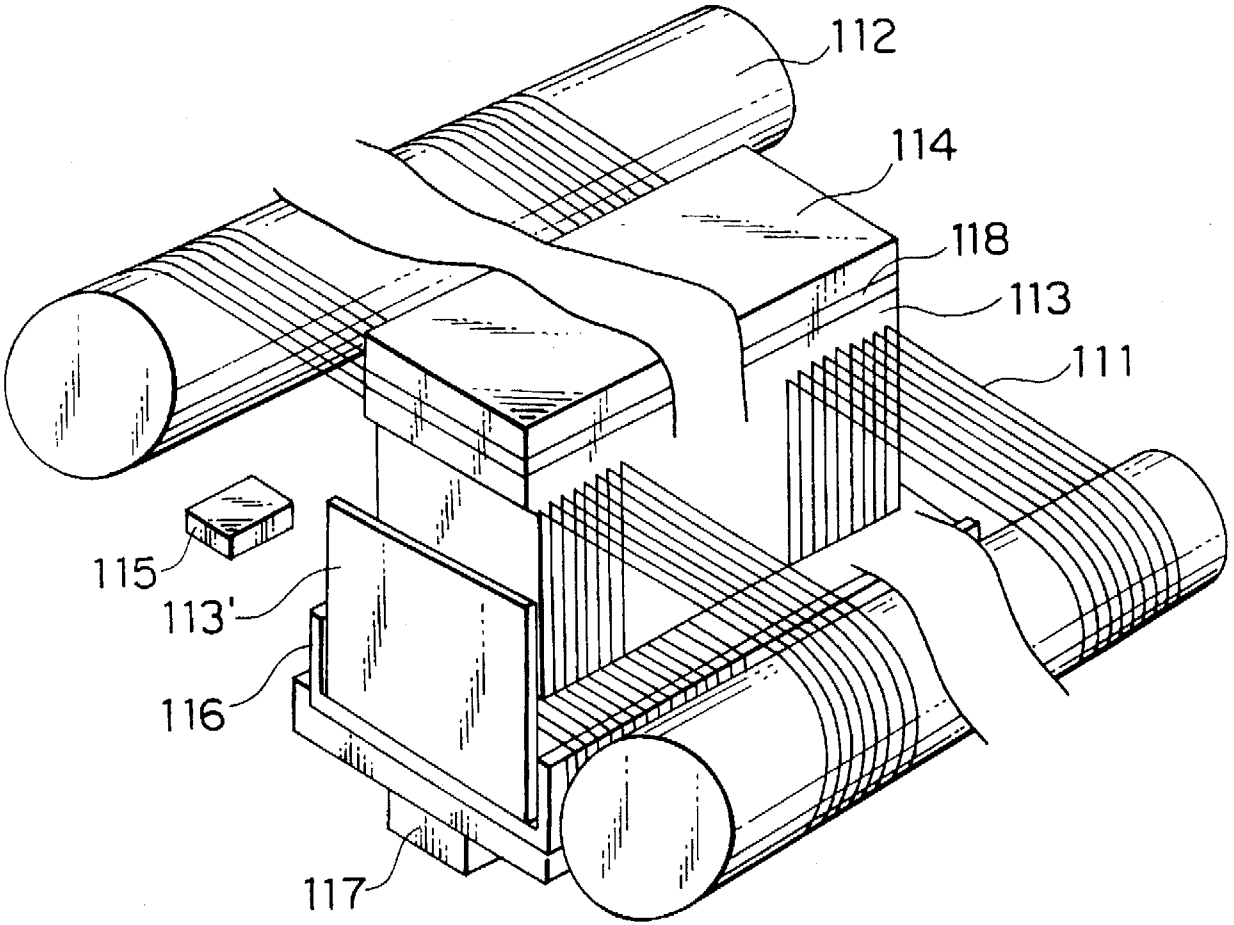
FIG. 6 is a perspective view of a multi-wire saw device according to an embodiment of the present invention.
Figure 7A:
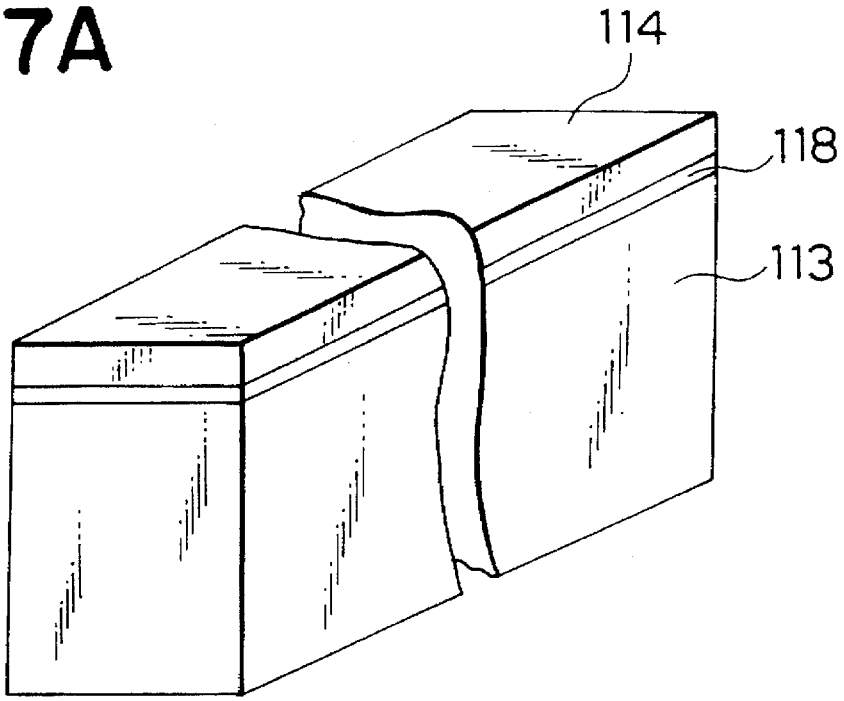
FIGS. 7A and 7B are perspective views showing an adhesion state of a semiconductor ingot and a disposable board, where
Figure 7B:
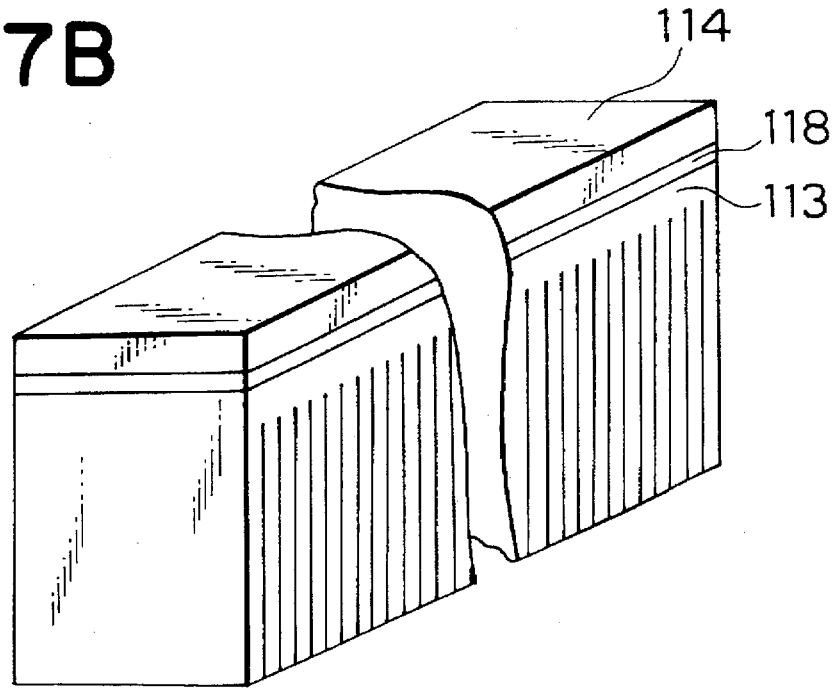

FIG. 6 is a perspective view of a multi-wire saw device according to another embodiment of the present invention. FIGS. 7A and 7B are perspective views showing an adhesion state of a semiconductor ingot and a disposable board, where FIG. 7A shows the state before slicing by wires and FIG. 7B shows the state after slicing.

As shown in FIG. 6, the relevant multi-wire saw device comprises wires 111, a wire guide 112 for tensely spanning the wires 111 at predetermined spaces, a disposable board 114 fastened to a base plate to be mounted in the MWS device for fixing a semiconductor ingot block 113, a $CO_2$ laser 115 for cutting said semiconductor ingot block 113 at a right angle to the cutting direction of said wire 111 and a wafer cassette 116 for housing semiconductor wafers 113' after cutting. In FIG. 6, 117 denotes a travelling wafer cassette stand.

The wires 111, as one example, 180 μm in diameter, and travel by wire driving mechanism not shown.

The wire guide 112 comprises, e.g., three wire guides, and each of these is provided with a plurality of grooves depending on the thickness of the semiconductor wafer 113' to be sliced and the diameter of the wires 111, with which grooves the wires 111 are spanned at predetermined spacing. Incidentally, only two wire guides are shown in FIG. 6.

The semiconductor ingot block 113, made of a crystalline silicon, whose wafer cut surface is 110 mm in length and 100 mm in length, comprises a parallelepiped, 160 mm long.

The disposable board 114, made, e.g., of glass board, carbon board or the like, is adhered and fixed through adhesives 118 at one width side of the semiconductor ingot block 113.

The disposable board 114 is fixed to the base plate mounted through adhesive and a metal plate such as aluminum or a carbon board in the MWS device. The base plate and the metal plate or carbon board are fastened with vises, or by inserting both ends of the metal plate or carbon board into the base plate.

The $CO_2$ laser 115, e.g., 500 W in output power and 2500 mm/min in cutting rate, with the assist gas of air, which is disposed to be movable vertically, longitudinally and transversely, sets the length of a semiconductor wafer 113' on the length side of a wafer cut surface of a semiconductor ingot block 113 by the vertical movement, cuts the semiconductor wafer 113' by the transverse movement and aligns the focal position of the $CO_2$ laser 115 to the semiconductor wafer 113' to be cut by the longitudinal movement.

The wafer cassette 116 includes housing sections for individually housing a semiconductor wafer 113' after cutting and, for example, comprises as many housing sections as the number of semiconductor wafers 113' to be cut.

Hereinafter, a slice method of the semiconductor ingot block 113 will be concretely described.

When slicing the semiconductor ingot block 113 into a semiconductor wafer 113', first, fix a metal plate such as aluminum or a carbon board on the base plate mounted in the MWS device with vises or by inserting both ends into the base plate.

Next, bond a disposable board 114 of glass or carbon board to the metal plate with adhesive, apply and harden adhesive 118 between the disposable board 114 and a semiconductor ingot block 113 at 50° C. for 2 hours for bonding together.

And, mount this set ingot holder in the MWS device and start slicing while applying slurry, a mixture of whetstone grains and oil, over both ends. Here, conditions for slicing are set to be as follows: 6 m/sec in the travelling rate of a wire, 300 μm in the lowering speed of a semiconductor ingot block 113, and 350 μm in board thickness of the semiconductor wafer 113' to be sliced.

Slicing proceeds and the wire 111 enters the semiconductor ingot block by 105 mm to 107 mm, when the travelling of the wire and the lowering of the semiconductor ingot block 113 stops.

Figure 8A:
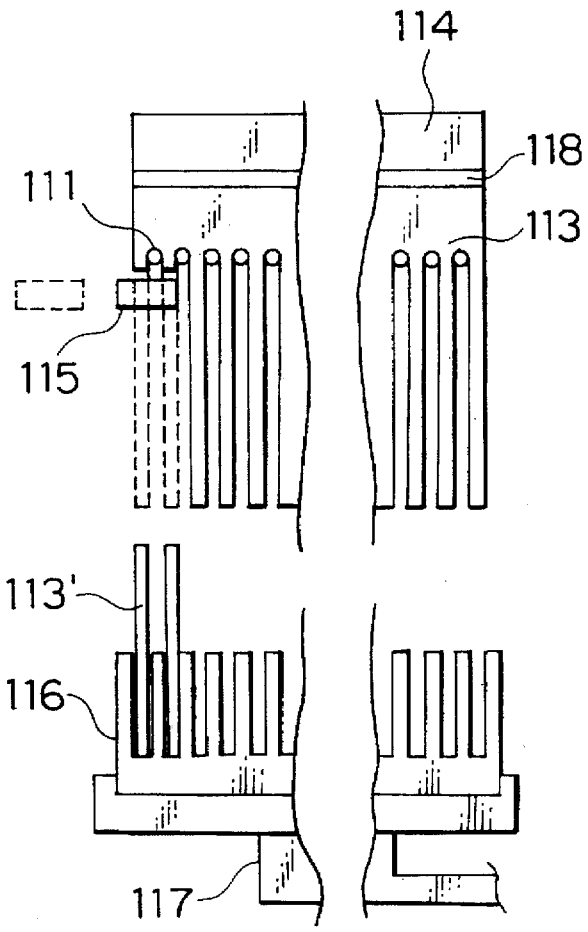
FIGS. 8A and 8B are to illustrate a slice method using the multi-wire saw device of FIG. 1, where
Figure 8B:
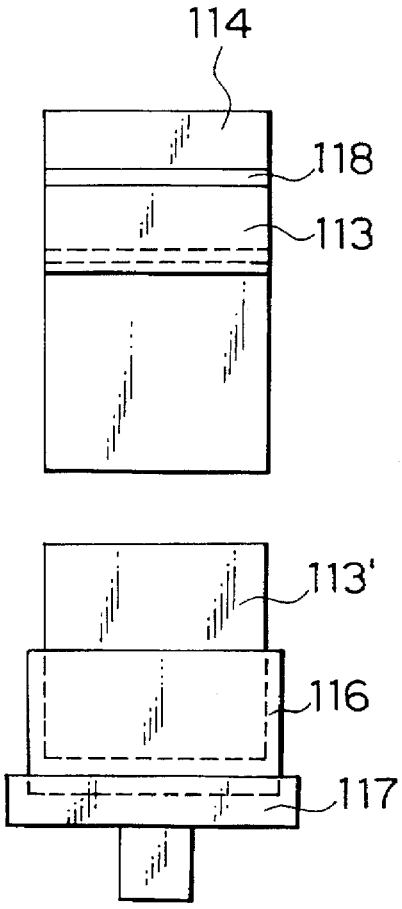

Next, move the $CO_2$ laser 115 to a predetermined position, that is, vertically move the $CO_2$ laser 115 in such a manner that the four sides of the wafer cut surface are equal in length (a semiconductor wafer of 100 mm×100 mm), transversely move the wafer in such a manner as to be positioned on either the left or right side with which a cut starts, and longitudinally move to adjust the focal position relative to the semiconductor wafer to be cut. As shown in FIGS. 8A and 8B, after aligning the position of the $CO_2$ laser 115 for each semiconductor wafer 113', cut individual semiconductor wafers 113' one by one.

As shown in FIGS. 8A and 8B, the relevant cut semiconductor wafer 113' is housed in the wafer cassette 116 provided below the semiconductor ingot block 113 (semiconductor wafer 113').

Here, in each individual semiconductor wafer 113', a variation in thickness, e.g., a variation of 350 μm±10 μm occurs.

Figure 9:
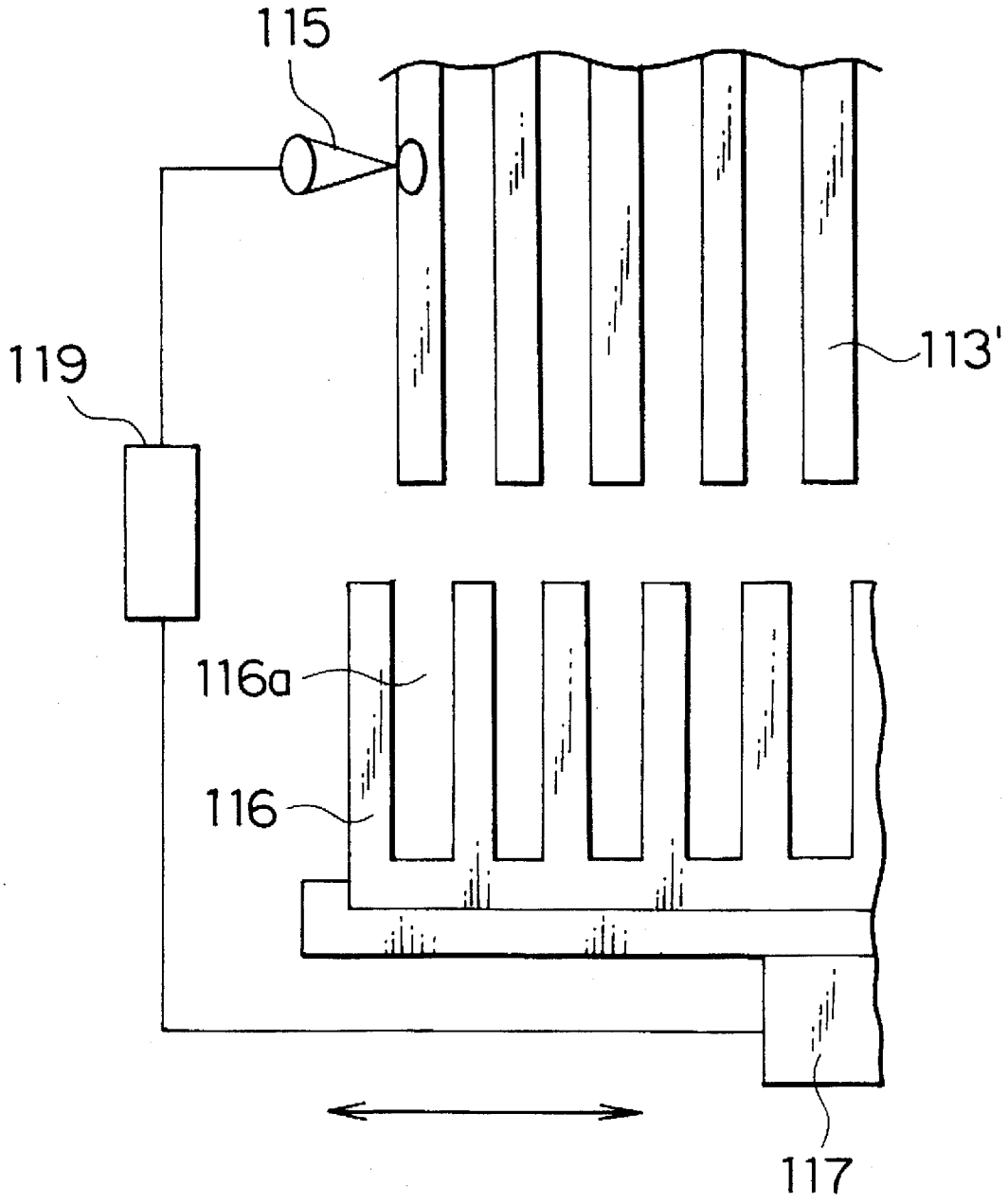
FIG. 9 is an explanatory drawing of the relation between the focal position of a laser and the housing section of a wafer cassette.
Figure 10A:
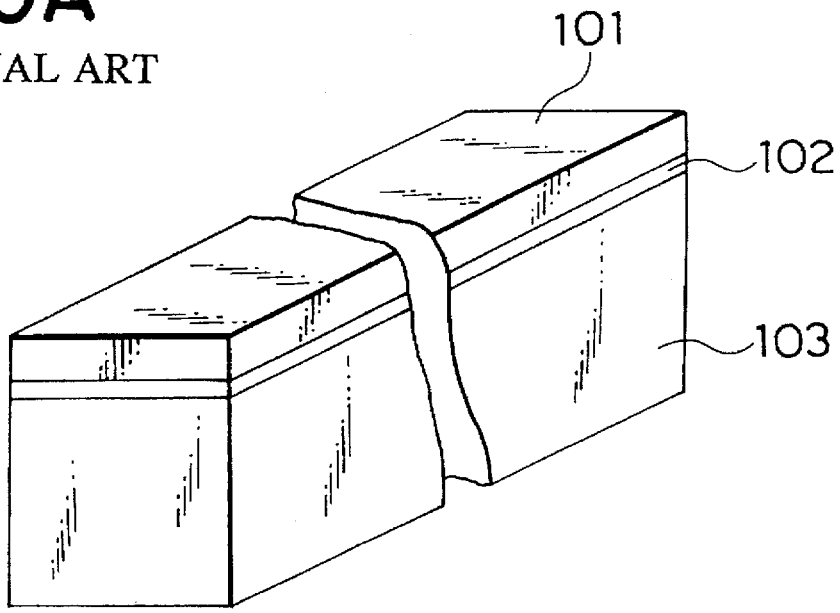
FIG. 10A CONVENTIONAL ART
FIG. 10A and 10B are perspective views showing the conventional adhesion state of a semiconductor ingot and a disposable board, where
Figure 10B:
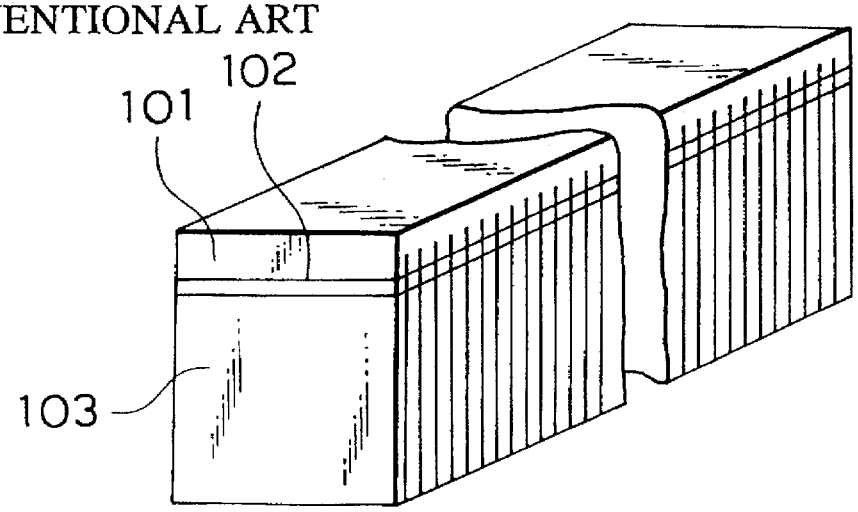
FIG. 10B CONVENTIONAL ART

Accordingly, as shown in FIG. 9, by having control means 119 for controlling the focal position of the $CO_2$ laser 115 corresponding to the semiconductor wafer 113' to be cut and the position of the housing area start surface in housing section **116*a* for housing the relevant semiconductor wafer 113' to come into much the same plane, for example, electrically sensing the focal position of the $CO_2$ laser 115 corresponding to the semiconductor wafer 113' to be cut and the position of the housing section 116*a* corresponding to the relevant semiconductor wafer 113' and mechanically moving the relevant housing section 116*a* in synchronization with this sensing, all semiconductor 113' wafers can be stably housed in individual housing sections 116*a* of the wafer cassette even if a variation occurs in the thickness of semiconductor wafers 113'. Thus, a mistake in housing, damage of semiconductor wafers 113' or the like can be prevented. To be specific, by a fine adjustment of the travelling wafer cassette stand 117, the position of the relevant housing section 116*a*** is adjusted.

As described above, with the multi-wire saw device of this embodiment, because of being arranged to comprise a laser 115 for cutting the semiconductor ingot block 113 at a right angle to the cutting direction of a wire 111, the semiconductor ingot block 113 can be cut and separated by using a wire 111 out of a row of wires and the laser 115. This makes it unnecessary to slice even the disposable board 114 with a wire 111. Thus, semiconductor wafers 113' can be obtained without use of a disposable board 114 or without waste because a disposable board can be recycled even if used and consequently a cost cut in materials can be achieved. Furthermore, separating a semiconductor wafer 113' from the disposable board 114 without use of solvent or the like becomes possible, thereby enhancing the operational efficiency.

By having a wafer cassette 116 provided for housing a semiconductor wafer 113' falling from the semiconductor ingot block 113 after the completion of cutting, semiconductor wafers 113', after cutting, are automatically housed in the wafer cassette 116, so that it becomes possible to omit the very laborious operation of manually separating semiconductor wafers hardly separable due to the residual slurry from each other, thereby enabling an increase in yield and operational efficiency.

By incorporating a plurality of housing sections **116*a* for individually housing individual semiconductor wafers 113' into the wafer cassette 116 and having control means 119 provided for controlling the focal position of the $CO_2$ laser 115 corresponding to the semiconductor wafer 113' to be cut and the position of the housing area start surface in the housing sections 116*a* for housing the relevant semiconductor wafer 113' to come into much the same plane, the semiconductor wafers 113' can be stably housed in the housing sections 116*a* of the wafer cassette 116 even if a variation occurs in the thickness of cut semiconductor wafers 113'**.

With the slice method according to the present invention, because the wafer cut surface of the semiconductor ingot block 113 comprises a rectangle and this method is arranged to comprise the steps of fixing the width side of the semiconductor ingot block 113 on the hold means; half-slicing the semiconductor ingot block 113 in the range from the width side up to the length side of the cut surface thereof; and cutting the semiconductor wafer after cutting in such a manner the wafer cut surface becomes a square by means of the laser, semiconductor wafers whose cut surface after cutting is a square can be consistently obtained without use of a disposable board 114 or without waste because a disposable board can be recycled if used.

Incidentally, a multi-wire saw device is described by using a parallelepiped of semiconductor ingot block in this embodiment, but needless to say, even if using a semiconductor ingot block having a partially flat cut surface in the width direction and held at the relevant cut surface by hold means, an equal advantage can be obtained.

As described above, with a multi-wire saw device according to the present invention, because of being arranged to comprise a laser for cutting the semiconductor ingot at a right angle to the cutting direction of the wire, it is possible to cut the semiconductor ingot into individual wafers by using a row of wires and the laser and separate them from each other. Thus, it becomes unnecessary to slice even the hold means by means of wires and moreover no disposable board as a part of the hold means is used or a disposable board can be recycled even if used, so that semiconductor wafers can be obtained without waste and a cost cut in materials can be achieved. Furthermore, separating a semiconductor wafer from the hold means without use of solvent or the like becomes possible, thereby enhancing the operational efficiency.

By having a wafer cassette provided for housing a semiconductor wafer to fall under the semiconductor ingot after the completion of cutting, semiconductor wafers after cutting are automatically housed in the wafer cassette, so that it becomes possible to omit the very laborious operation of manually separating semiconductor wafers hardly separable due to the residual slurry from each other, thereby enabling an increase in yield and operational efficiency, By incorporating a housing section for individually housing each individual semiconductor wafer into the wafer cassette and having control means provided for controlling the focal position of the laser on the semiconductor wafer to be cut and the position of the housing area start surface in the housing section for housing the relevant semiconductor wafer to come into much the same plane, the semiconductor wafers can be stably housed in the housing section of the wafer cassette even if a variation occurs in the thickness of cut semiconductor wafers.

With the slice method according to the present invention, because the wafer cut surface of the semiconductor ingot comprises a rectangle and this method is arranged to comprise the steps of fixing the short side of the semiconductor ingot on the hold means; half-slicing the semiconductor ingot in the range from the short side up to the long side of the cut surface thereof; and cutting the semiconductor wafer after cutting in such a manner, the wafer cut surface becomes a square by means of the laser, semiconductor wafers whose cut surface after cutting is a square can be consistently obtained without use of a disposable board as a part of the hold means or without wasting a disposable board if used.

Many widely different embodiments of the present invention may be constructed without departing from the spirit and scope of the present invention. It should be understood that the present invention is not limited to the specific embodiments described in the specification, but as defined in the appended claims.

What is claimed is:

1. A method of cutting a semiconductor ingot into a plurality of wafers comprising the steps of:

providing a multi-wire saw device including a plurality of tautly drawn cutting wires, the cutting wires being spaced at predetermined distances from one-another; holding means for holding the semiconductor ingot; and a laser for cutting the semiconductor ingot at a substantially right angle to a cutting direction of said cutting wires;

fixing holding means the width sides of the semiconductor ingot;

cutting with the cutting wires a first distance from a first longitudinal surface toward a second longitudinal surface of the semiconductor ingot to form a plurality of rectangular cut surfaces; and using the laser to cut the semiconductor ingot at a second distance from the first longitudinal surface, said second distance being less than said first distance to form semiconductor wafers having a pair of substantially square surfaces.

2. A multi-wire saw for cutting a semiconductor ingot into a plurality of wafers, comprising a plurality of cutting wires, the wires being capable of travel in a longitudinal direction thereof and being spaced at predetermined distances from each other, hold means for holding the semiconductor ingot therein and moving the semiconductor ingot at a substantially right angle to the travelling direction of the wires for cutting the semiconductor ingot into the plurality of wafers, and a wafer housing cassette, wherein the semiconductor ingot is arranged to let each of the plurality of wafers fall from the hold means into said wafer housing cassette after completion of cutting of the semiconductor ingot.

3. The multi-wire saw as set forth in claim 2, wherein the hold means comprises a first sandwich holding section for the semiconductor ingot therein during a first period of the cutting and a second sandwich holding section for holding the semiconductor ingot therein during a second period of the cutting.

4. The multi-wire saw as set forth in claim 2, wherein the wafer housing cassette includes a plurality of partitioning wires having a diameter in a range of 50 to 300 μm, said partitioning wires being spaced form each other for separating the wafers.

5. A multi-wire saw device for cutting a semiconductor ingot into a plurality of wafers, comprising a plurality of cutting wires, said cutting wires being tautly drawn at predetermined intervals from one another, hold means for holding said semiconductor ingot; and a laser for cutting said the semiconductor ingot at a substantially right angle to the longitudinal direction of said cutting wires.

6. The multi-wire saw device as set forth in claim 5, wherein said laser is arranged to be movable vertically, longitudinally and transversely.

7. The multi-wire saw device as set forth in claim 5, further comprising a wafer cassette, said wafer cassette being disposed beneath the semiconductor ingot for receiving the semiconductor wafers cut therefrom.

8. The multi-wire saw device as set forth in claim 7, wherein said wafer cassette includes a plurality of housing sections for individually housing individual semiconductor wafers and further comprises control means for controlling the focal position of the laser on each wafer to be cut and the position of a housing area start surface in each of said housing sections such that each semiconductor wafer is aligned to be received in one of said housing sections.

* * * * *